US010690396B2

(12) United States Patent
Yuan

(10) Patent No.: US 10,690,396 B2
(45) Date of Patent: Jun. 23, 2020

(54) LEVELING FOOT STRUCTURE AND HOUSEHOLD APPLIANCE

(71) Applicants: HEFEI HUALING CO., LTD., Hefei (CN); HEFEI MIDEA REFRIGERATOR CO., LTD., Hefei (CN); MIDEA GROUP CO., LTD., Foshan (CN)

(72) Inventor: Jinguo Yuan, Hefei (CN)

( * ) Notice: Subject to any disclaimer, the term of this patent is extended or adjusted under 35 U.S.C. 154(b) by 0 days.

(21) Appl. No.: 16/282,318

(22) Filed: Feb. 22, 2019

(65) Prior Publication Data

US 2019/0186810 A1 Jun. 20, 2019

Related U.S. Application Data

(63) Continuation of application No. PCT/CN2017/075258, filed on Feb. 28, 2017.

(30) Foreign Application Priority Data

Oct. 20, 2016 (CN) ..... 2016 2 1144328 U

(51) Int. Cl.
*F16M 11/24* (2006.01)
*F25D 23/10* (2006.01)
*F25D 23/00* (2006.01)

(52) U.S. Cl.
CPC ..... *F25D 23/10* (2013.01); *F25D 23/00* (2013.01); *F25D 2323/0011* (2013.01)

(58) Field of Classification Search
CPC .. A47B 91/02; F25D 23/10; F25D 2323/0011
See application file for complete search history.

(56) References Cited

U.S. PATENT DOCUMENTS 4,056,903 A * 11/1977 Guarnere ..... E04B 2/7422 52/126.4
4,484,392 A * 11/1984 DeFino ..... E04F 21/1855 33/647

(Continued)

FOREIGN PATENT DOCUMENTS

CN 2784843 Y 5/2006
CN 101175942 A 5/2008

(Continued)

OTHER PUBLICATIONS

The Extended European Search Report dated Jul. 11, 2019 corresponding to EP application No. 17862314.6.

(Continued)

*Primary Examiner* — Amy J. Sterling
(74) *Attorney, Agent, or Firm* — Kilpatrick Townsend & Stockton, LLP

(57) ABSTRACT

A leveling foot structure for a household appliance comprises a base, a first fastener, and a position-limiting block. A through-hole is arranged at a side wall of the base. The position-limiting block is movably connected to the base by means of the first fastener. The first fastener partially passes through the through-hole to connect to the position-limiting block. The position-limiting block is rotatable around an axis of the first fastener, and is movable along an axial direction of the first fastener. After rotation of the position-limiting block, the position-limiting block at least partially protrudes from a bottom surface of the base.

15 Claims, 8 Drawing Sheets

(56) References Cited

U.S. PATENT DOCUMENTS 4,600,183 A * 7/1986 Ogden ..... B25B 11/00
269/43
5,160,126 A * 11/1992 Atkinson ..... A47B 95/008
269/102

FOREIGN PATENT DOCUMENTS

| | | | |
|---|---|---|---|
| CN | 102138149 | A | 9/2011 |
| CN | 104019603 | A | 9/2014 |
| CN | 203860787 | U | 10/2014 |
| CN | 203873302 | U | 10/2014 |
| DE | 7915766 | U1 | 11/1980 |
| EP | 2537441 | A1 | 12/2012 |
| JP | 2002209774 | A | 7/2002 |
| JP | 3736218 | B2 | 1/2006 |

OTHER PUBLICATIONS

International Search Report dated Jul. 24, 2017 in the corresponding PCT application(application No. PCT/CN2017075258).
The first Office Action dated Jan. 7, 2020 in the corresponding CA application No. 3,033,036.

* cited by examiner

LEVELING FOOT STRUCTURE AND HOUSEHOLD APPLIANCE

PRIORITY CLAIM AND RELATED APPLICATION

The present application is a continuation of International Application No. PCT/CN2017/075258, filed on Feb. 28, 2017, which claims the priority to Chinese patent application No. 201621144328.1, filed with the Chinese Patent Office on Oct. 20, 2016 and entitled "Leveling foot structure and Household Appliance", all of which is incorporated herein by reference in its entirety.

FIELD

The present disclosure relates to the field of household appliances, and particularly to a leveling foot structure and a household appliance.

BACKGROUND

At present, in the related art, as shown in FIG. 1 to FIG. 4, the foot 104' of a household appliance merely serves the function of supporting and fixing the household appliance. When it is necessary to install a household appliance in a positioned manner and there are high requirements upon the precision of position, the installer needs to make repeated measurements and trials for the installation position, which leads to high installation difficulty and is also time-consuming and laborious.

As shown in FIG. 1 and FIG. 2, the door body of a cabinet refrigerator 10' is connected to the door of the cabinet by means of a slide rail or a hinge. When the cabinet door 20' is opened, the refrigerator door 102' is opened simultaneously, and when the cabinet door 20' is closed, the refrigerator door 102' is closed simultaneously. When the refrigerator of this kind is placed into a cabinet, there is a strict requirement on the pushed-in depth thereof. If the actual installation size is greatly different from the theoretical value, there will occur the case where the cabinet door 20' is closed in place, but the refrigerator door 102' is not closed properly, or the case where the refrigerator door 102' is closed in place, but the cabinet door 20' is not closed properly. Therefore, during the practical installation process, it is necessary for the installer to repeatedly measure the distance in the depth direction between the refrigerator and the cabinet body in the process of pushing the refrigerator into the cabinet, so as to ensure that the installation size is correct. Such operation mode is time-consuming and laborious. It is difficult for a single person to implement such operation mode.

SUMMARY

One embodiment of the present disclosure is to propose a leveling foot structure.

Another embodiment of the present disclosure is to propose a household appliance.

In another embodiment of the present disclosure, the present disclosure provides a leveling foot structure, comprising a base, a first fastener and a position-limiting block; a through-hole being arranged at a side wall of the base; the position-limiting block being movably connected to the base by means of the first fastener and the first fastener partially passing through the through-hole to connect to the position-limiting block; and the position-limiting block is rotatable around an axis of the first fastener and is movable along an axial direction of the first fastener; and after rotation of the position-limiting block, the position-limiting block at least partially protrudes from a bottom surface of the base.

For the leveling foot structure provided by the present disclosure, by providing a position-limiting block, a household appliance is endowed with a positioning function in the installation process. In the installation process of a household appliance, the installer can accurately determine the installation position of the household appliance merely by performing positioning with the position-limiting block, which spares the installer from manual measurement and repeated adjustment. The installation is convenient and efficient. It saves time and labor, which effectively reduces the work difficulty and work intensity of the installer.

leveling foot structure In one embodiment, the bottom of a wall of the base connected with the position-limiting block is provided with a first installation hole at the end provided with the through-hole and by passing a second fastener through the first installation hole, the base is fixedly connected to a fixed body that needs to be fixed to the household appliance, so as to fix the base.

In one embodiment, the foot is fixed by passing the second fastener through the first installation hole. The installation is convenient and efficient. The connection strength is high and the connection is firm, which effectively prevents the household appliance from being moved by an external force.

In one embodiment, an installation platform is provided at the bottom of the base, the installation platform is provided with a second installation hole and the base is connected to the household appliance by passing a third fastener through the second installation hole.

In one embodiment, the foot is connected to the household appliance by means of the third fastener, which is simple and firm, facilitating the fitting of the foot.

In one embodiment, there are two first installation holes, located on two sides of the through-hole, respectively.

In one embodiment, the number of first installation holes is two, so that the foot is uniformly stressed and the installation is completed firmly.

In one embodiment, the base is provided with a downwardly recessed groove in which the first installation hole is located.

In one embodiment, by providing the first installation hole in the groove, it is ensured that the fastener is entirely embedded in the groove, effectively preventing the user or an article from being scratched by the fastener to cause injuries and loss.

In one embodiment, the leveling foot structure further comprises a foot cover plate which is fastened to the groove for opening or closing the groove.

In one embodiment, by fastening the foot cover plate to the groove to hide the fastener in the groove, the foot has a clean and tidy appearance, which ensures the overall aesthetics of the household appliance and effectively improves the user experience.

In one embodiment, the foot cover plate and the base are connected by snap fit.

In one embodiment, the foot cover plate and the base are connected by snap fit. The installation mode is simple and convenient, which facilitates installation and removal.

In one embodiment, a spring is provided between the first fastener and the base for rotating the position-limiting block and/or restoring the protruding position-limiting block.

In one embodiment, by providing a spring on the first fastener, the position-limiting block can be automatically restored after use; moreover, after the completion of the installation, the spring will exert a stress to the position-limiting block, so that the position-limiting block will not move randomly, ensuring aesthetics and integrity of the foot as a whole.

According to one embodiment of the present disclosure, the present disclosure provides a household appliance, comprising the leveling foot structure according to any of the embodiments described above. Therefore, the household appliance has all the advantageous effects of the leveling foot structure of any of the embodiments described above.

In one embodiment, the household appliance is a cabinet refrigerator.

In one embodiment, the method of installing the cabinet refrigerator in a cabinet is as follows: step 101, placing the cabinet refrigerator in the cabinet; step 103, rotating the position-limiting block on the foot by 90° before completely pushing the cabinet refrigerator into the cabinet; step 105, completely pushing the cabinet refrigerator into the cabinet, and at this time, the spring is compressed to the limit and further pushing is impossible; step 107, rotating the position-limiting block by 90°, and the position-limiting block is restored under the action of the spring, at this time, the position-limiting block is kept flush with the cabinet body and door closing is not affected; step 109, opening the foot cover plate and fixing the foot to a wooden cabinet with two bolts to prevent the cabinet refrigerator from moving during door opening; and step 111, closing the foot cover plate and completing the installation. The cabinet refrigerator is installed in the cabinet by this method. The foot can ensure the correct position of the cabinet refrigerator in the cabinet in the depth direction, which spares the user from manual measurement and repeated adjustment; the installation process is simple, which is time-saving and labor-saving, and effectively improves the work efficiency.

BRIEF DESCRIPTION OF DRAWINGS

Embodiments of the present disclosure will become apparent and readily understood from the description of the embodiments in connection with the following drawings, in which.

The corresponding relation between reference signs in FIG. 1 to FIG. 16 and the component names is as follows:

10': cabinet refrigerator; 20': cabinet; 102': refrigerator door; 104': foot; 10: household appliance; 102: cabinet refrigerator; 20: foot; 202: base; 2022: through-hole; 2024: first installation hole; 2026: second installation hole; 204: position-limiting block; 206: first fastener; 208: foot cover plate; 210: spring; 30: cabinet

DETAILED DESCRIPTION OF EMBODIMENTS

In order to understand embodiments of the present disclosure more clearly, further detailed description is made on the present disclosure in connection with the accompanying drawings and the embodiments. It should be noted that the embodiments of the present application and the features of the embodiments can be combined with each other if there is no conflict.

In the following description, numerous details are set forth to facilitate full understanding of the present disclosure. However, the present disclosure may also be implemented in other ways than those described herein. Thus, the protection scope of the present disclosure is not limited by the embodiments disclosed below.

Next, a leveling foot structure and a household appliance according to some embodiments of the present disclosure will be described with reference to FIG. 5 to FIG. 16.

In an embodiment of the present disclosure, as shown in FIG. 5 to FIG. 10, the present disclosure provides a leveling foot structure, comprising a base 202, a first fastener 206 and a position-limiting block 204; a through-hole 2022 being arranged at a side wall of the base 202; the position-limiting block 204 being movably connected to the base 202 by means of the first fastener 206, and the first fastener 206 partially passing through the through-hole 2022 to connect to the position-limiting block 204; and the position-limiting block 204 is rotatable around an axis of the first fastener 206 and is movable along an axial direction of the first fastener 206; and after rotation of the position-limiting block, the position-limiting block 204 at least partially protrudes from a bottom surface of the base 202.

In this embodiment, by providing a position-limiting block 204, the household appliance 10 is endowed with a positioning function in the installation process. In the installation process of the household appliance 10, the installer can accurately determine the installation position of the household appliance 10 merely by performing positioning with the position-limiting block 204, which spares the installer from manual measurement and repeated adjustment. The installation is convenient and efficient and saves time and labor, which effectively reduces the work difficulty and work intensity of the installer.

Figure 1:
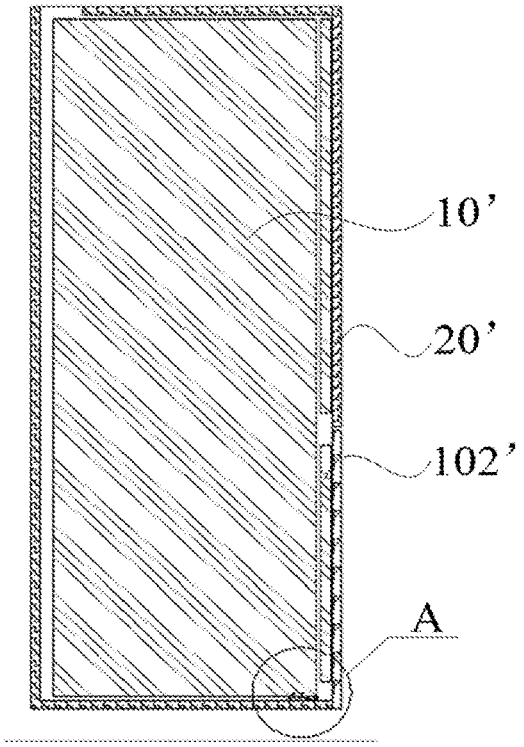
Prior Art Fig. 1
FIG. 1 is a schematic diagram of an installation structure of a cabinet refrigerator in the related art.
Figure 2:
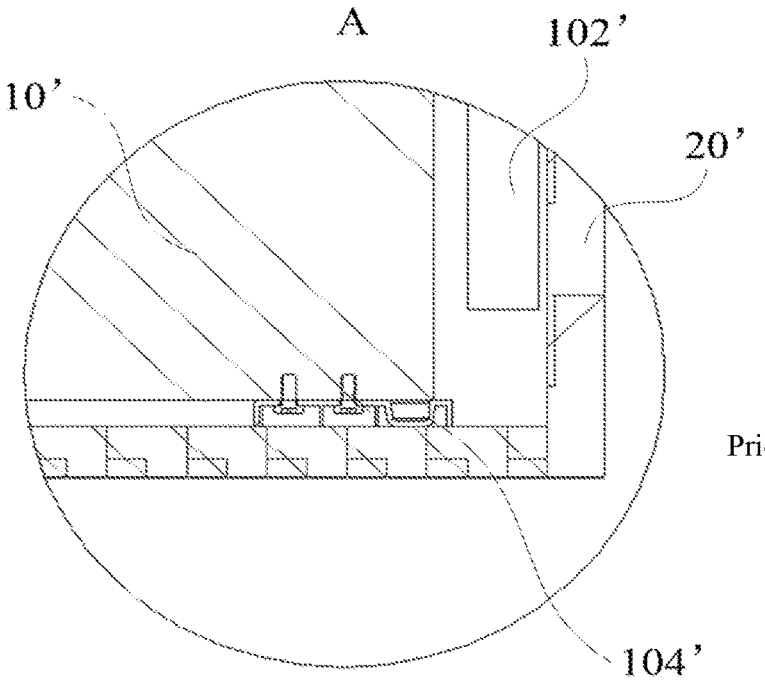
Prior Art Fig. 2
FIG. 2 is a partially enlarged view of the installation structure of the cabinet refrigerator in the related art shown in FIG. 1, at position A.
Figure 3:
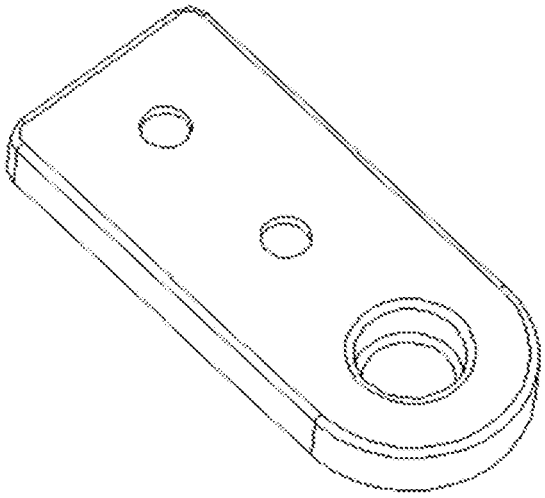
Prior Art Fig. 3
FIG. 3 is a schematic diagram of a leveling foot structure in the related art.
Figure 4:
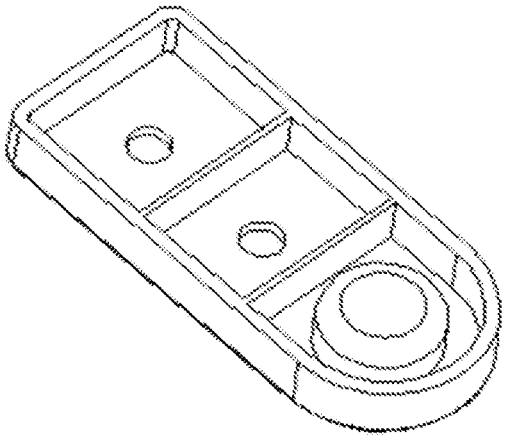
Prior Art Fig. 4
FIG. 4 is a bottom view of the leveling foot structure in the related art shown in FIG. 3.
Figure 5:
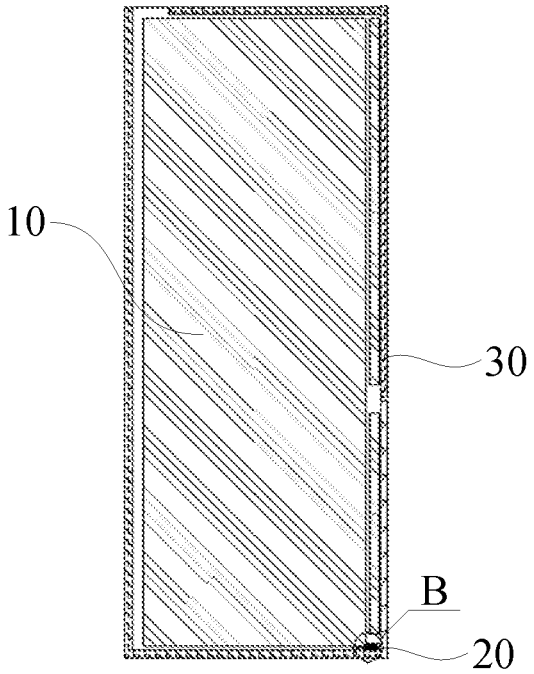
FIG. 5 is a schematic diagram of an installation structure of a household appliance according to one embodiment of the present disclosure.
Figure 6:
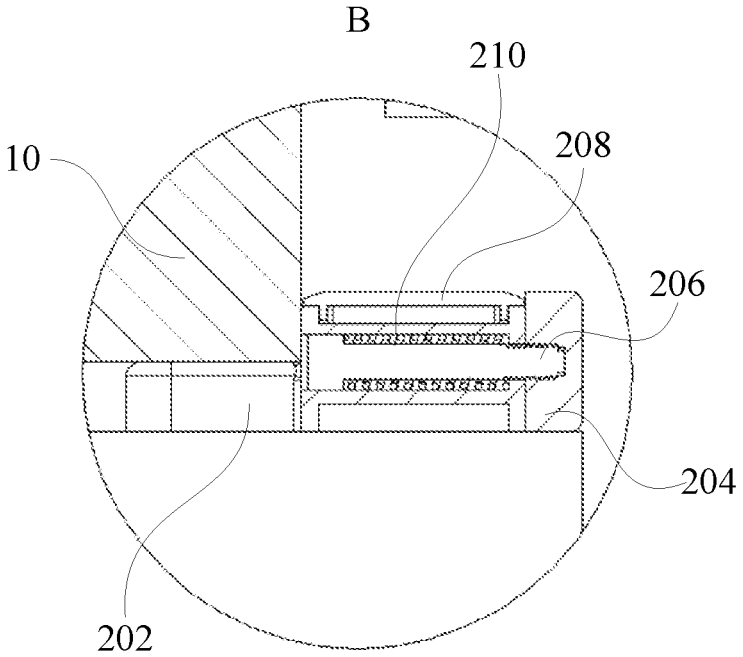
FIG. 6 is a partially enlarged view of the installation structure of the household appliance according to one embodiment of the present disclosure shown in FIG. 5, at position B.
Figure 7:
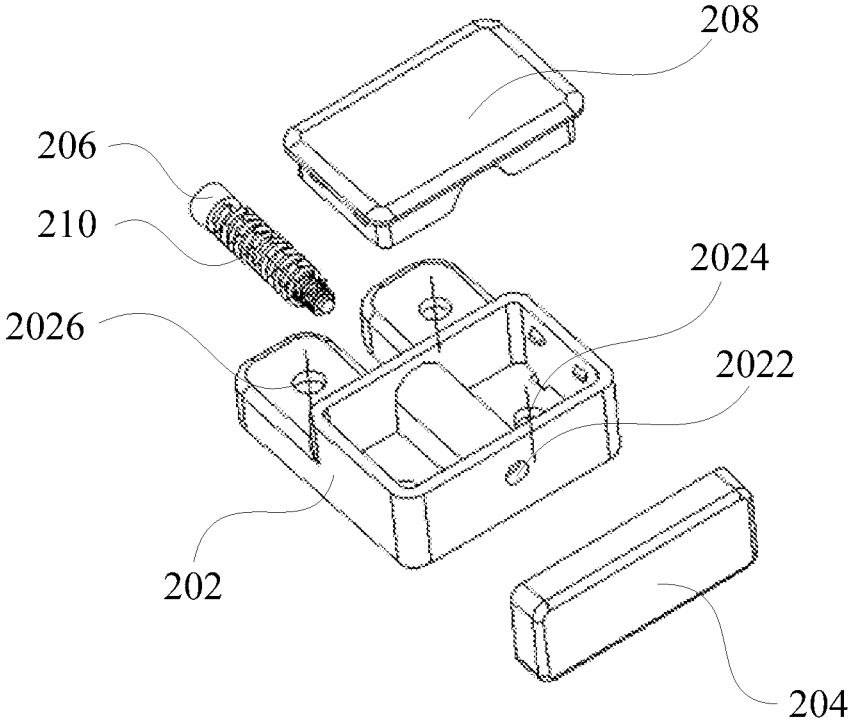
FIG. 7 is an exploded view of a leveling foot structure according to one embodiment of the present disclosure.
Figure 8:
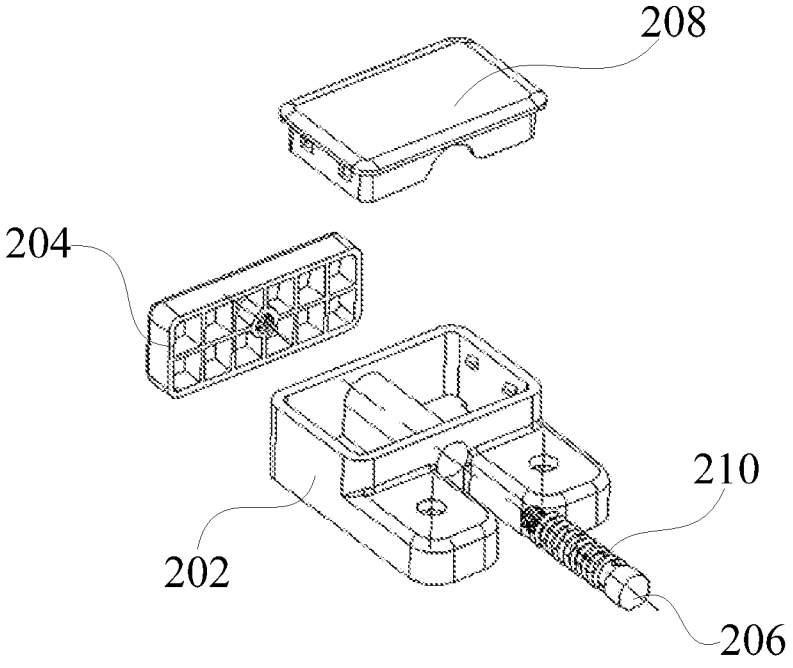
FIG. 8 is a rear view of the leveling foot structure according to one embodiment of the present disclosure shown in FIG. 7.
Figure 9:
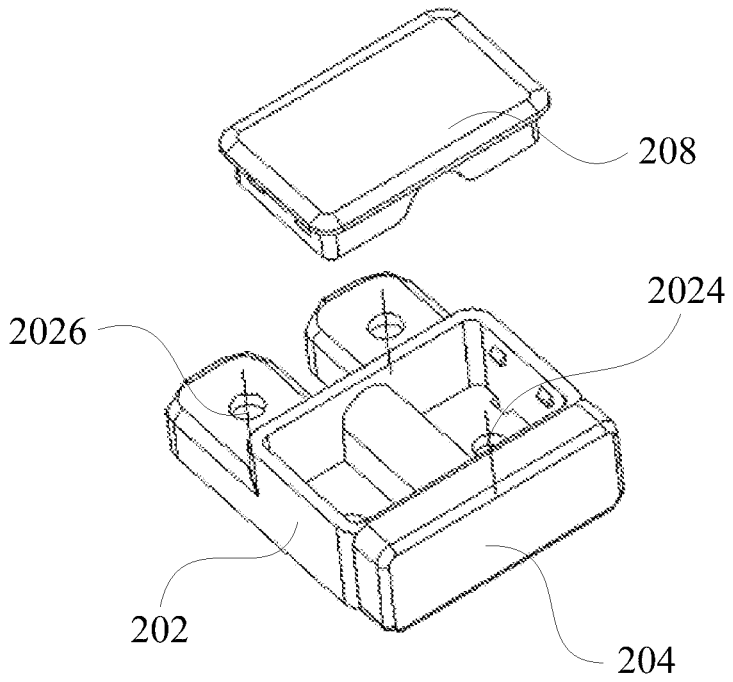
FIG. 9 is a schematic diagram of a leveling foot structure according to one embodiment of the present disclosure.
Figure 10:
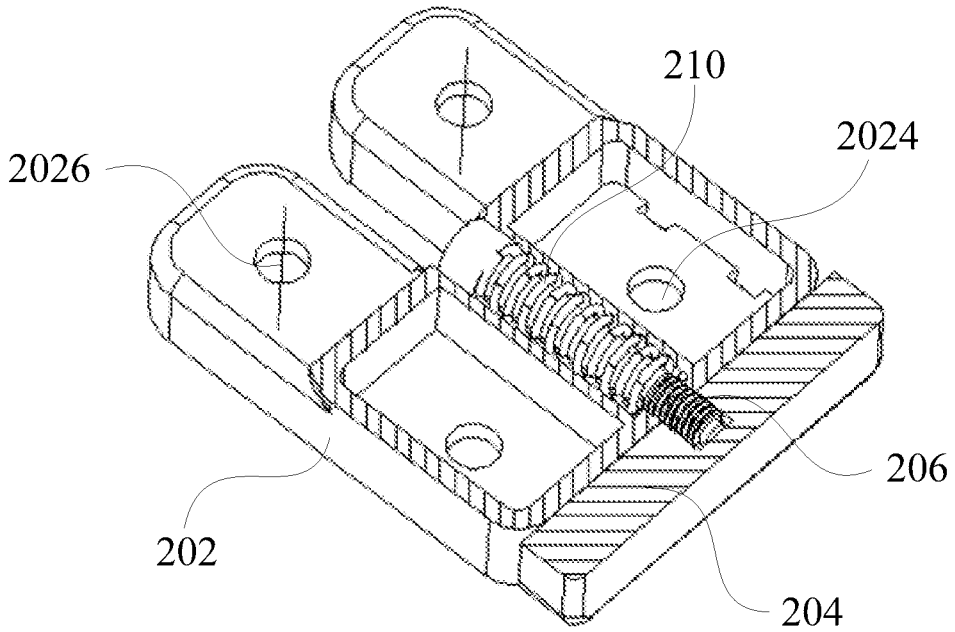
FIG. 10 is a sectional view of a leveling foot structure according to one embodiment of the present disclosure.

In one embodiment of the present disclosure, preferably, as shown in FIG. 7 and FIG. 8, the bottom of a wall of the base 202 connected with the position-limiting block 204 is provided with a first installation hole 2024 at the end provided with the through-hole 2022 and by passing a second fastener through the first installation hole 2024, the base 202 is fixedly connected to a fixed body that needs to be fixed to the household appliance 10, so as to fix the base 202.

In this embodiment, the foot 20 is fixed by passing the second fastener through the first installation hole 2024. The installation is convenient and efficient, the connection strength is high and the connection is firm, which effectively prevents the household appliance 10 from being moved by an external force.

In one embodiment of the present disclosure, preferably, as shown in FIG. 7 and FIG. 8, an installation platform is provided at the bottom of the base 202, the installation platform is provided with a second installation hole 2026 and the base 202 is connected to the household appliance 10 by passing a third fastener through the second installation hole 2026.

In this embodiment, the foot 20 is connected to the household appliance 10 by means of the third fastener, which is simple and firm, facilitating the fitting of the foot 20.

In one embodiment of the present disclosure, preferably, as shown in FIG. 7 and FIG. 8, there are two first installation holes 2024, located on two sides of the through-hole 2022, respectively.

In this embodiment, the number of first installation holes 2024 is two, so that the foot 20 is uniformly stressed and the installation is completed firmly.

In one embodiment of the present disclosure, preferably, as shown in FIG. 7 and FIG. 8, the base 202 is provided with a downwardly recessed groove in which the first installation hole 2024 is located.

In this embodiment, by providing the first installation hole 2024 in the groove, it is ensured that the fastener is entirely embedded in the groove, effectively preventing the user or an article from being scratched by the fastener to cause injuries and loss.

In one embodiment of the present disclosure, preferably, as shown in FIG. 7 and FIG. 8, the leveling foot structure further comprises a foot cover plate 208 which is fasten to the groove for opening or closing the groove.

In this embodiment, by fastening the foot cover plate 208 to the groove to hide the fastener in the groove, the foot 20 has a clean and tidy appearance, which ensures the overall aesthetics of the household appliance 10 and effectively improves the user experience.

In one embodiment of the present disclosure, preferably, as shown in FIG. 7 and FIG. 8, the foot cover plate 208 and the base 202 are connected by snap fit.

In this embodiment, the foot cover plate 208 and the base 202 are connected by snap fit. The installation mode is simple and convenient, which facilitates installation and removal.

In one embodiment of the present disclosure, preferably, as shown in FIG. 7 and FIG. 8, a spring 210 is provided between the first fastener 206 and the base 202 for rotating the position-limiting block 204 and/or restoring the protruding position-limiting block 204.

In this embodiment, by providing a spring 210 on the first fastener 206, the position-limiting block 204 can be automatically restored after use; moreover, after the completion of the installation, the spring 210 will exert a stress to the position-limiting block 204, so that the position-limiting block 204 will not move randomly, ensuring aesthetics and integrity of the foot 20 as a whole.

In an embodiment of the present disclosure, the present disclosure provides a household appliance 10, comprising the leveling foot structure according to any of the embodiments described above. Therefore, the household appliance 10 has all the advantageous effects of the leveling foot structure of any of the embodiments described above.

In one embodiment of the present disclosure, preferably, the household appliance 10 is a cabinet refrigerator 102.

Figure 11:
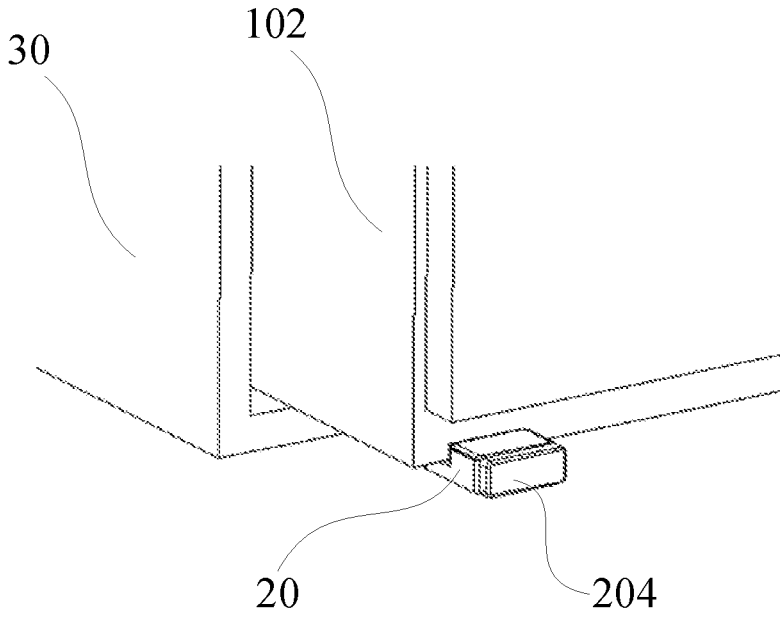
FIG. 11 is a schematic diagram of cabinet refrigerator installation step 101 according to one embodiment of the present disclosure.
Figure 12:
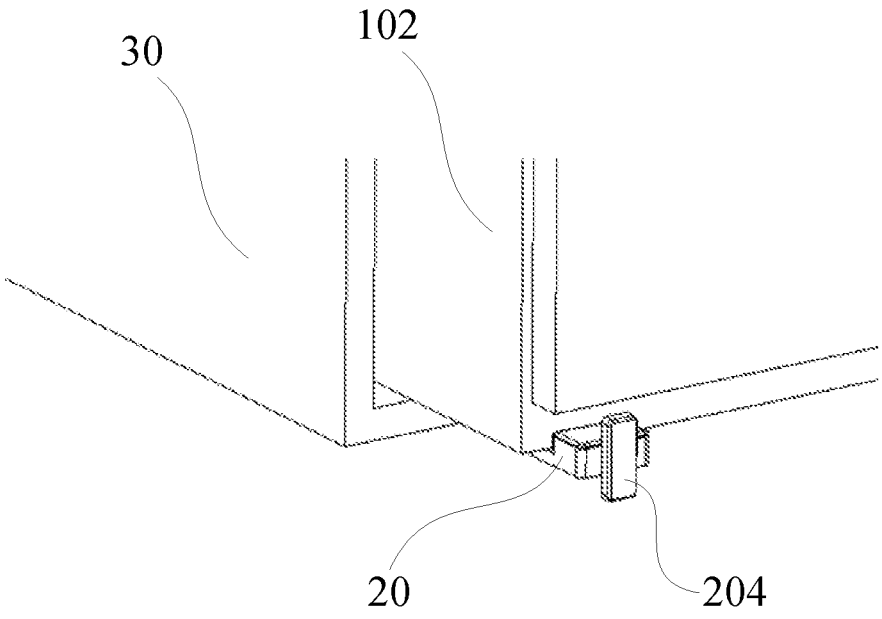
FIG. 12 is a schematic diagram of cabinet refrigerator installation step 103 according to one embodiment of the present disclosure.
Figure 13:
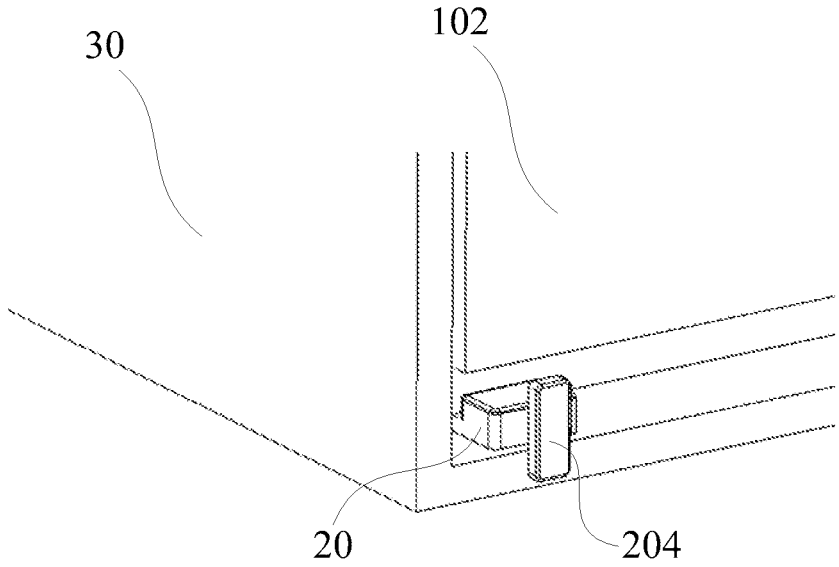
FIG. 13 is a schematic diagram of cabinet refrigerator installation step 105 according to one embodiment of the present disclosure.
Figure 14:
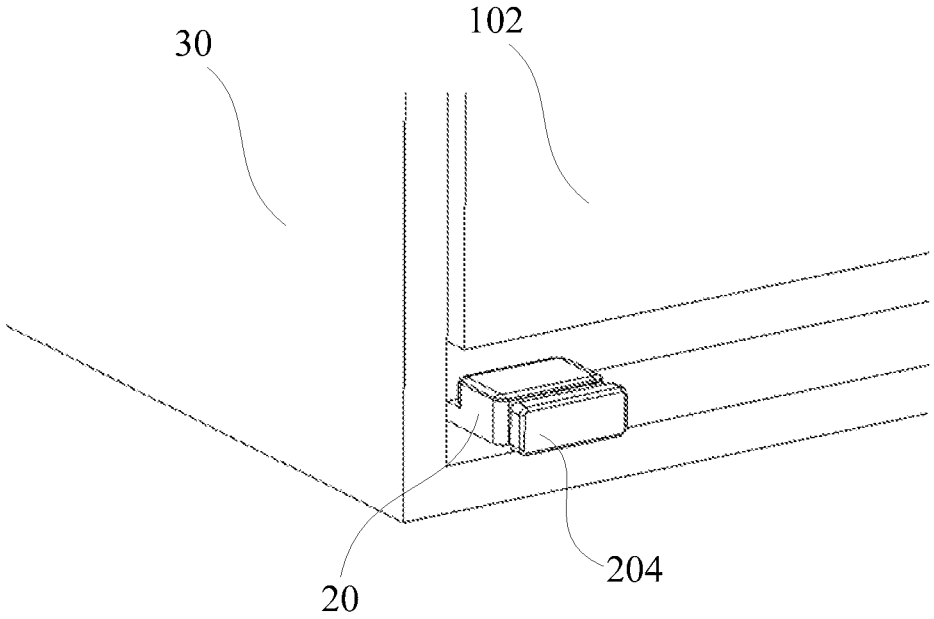
FIG. 14 is a schematic diagram of cabinet refrigerator installation step 107 according to one embodiment of the present disclosure.
Figure 15:
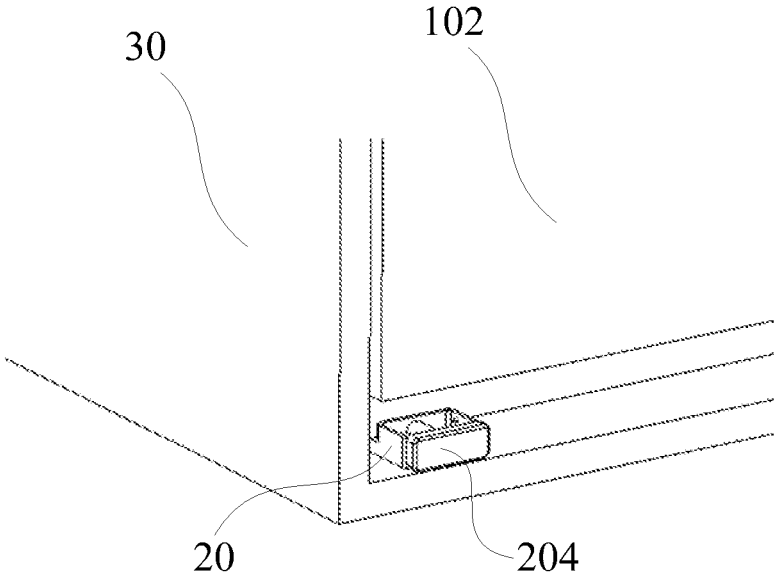
FIG. 15 is a schematic diagram of cabinet refrigerator installation step 109 according to one embodiment of the present disclosure.
Figure 16:
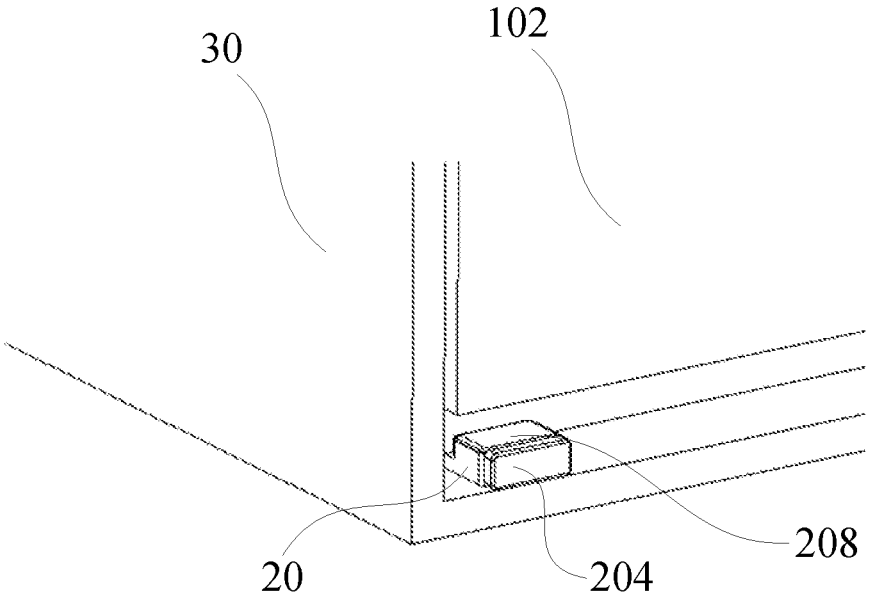
FIG. 16 is a schematic diagram of cabinet refrigerator installation step 111 according to one embodiment of the present disclosure.

In this embodiment, the method of installing the cabinet refrigerator 102 in a cabinet 30 is as follows: step 101, placing the cabinet refrigerator 102 in the cabinet 30, as shown in FIG. 11; step 103, rotating the position-limiting block 204 on the foot by 90° before completely pushing the cabinet refrigerator 102 into the cabinet 30, as shown in FIG. 12; step 105, completely pushing the cabinet refrigerator 102 into the cabinet 30, wherein at this time, the spring 210 is compressed to the limit and further pushing is impossible, as shown in FIG. 13; step 107, rotating the position-limiting block 204 by 90°, wherein the position-limiting block 204 is restored under the action of the spring 210, at this time, the position-limiting block 204 is kept flush with the cabinet body and door closing is not affected, as shown in FIG. 14; step 109, opening the foot cover plate 208 and fixing the foot to a wooden cabinet with two bolts to prevent the cabinet refrigerator 102 from moving during door opening, as shown in FIG. 15; and step 111, closing the foot cover plate 208 and completing the installation, as shown in FIG. 16. The cabinet refrigerator 102 is installed in the cabinet 30 by this method. The foot can ensure the correct position of the cabinet refrigerator 102 in the cabinet 30 in the depth direction, which spares the user from manual measurement and repeated adjustment; the installation process is simple, which is time-saving and labor-saving and effectively improves the work efficiency.

What is claimed is:

1. A leveling foot structure configured to be used in a household appliance, the leveling foot structure comprises:

a base, a through-hole being arranged at a side wall of the base;

a first fastener; and a position-limiting block, the position-limiting block being movably connected to the base by the first fastener and the first fastener partially passing through the through-hole to connect to the position-limiting block;

wherein the position-limiting block is rotatable around an axis of the first fastener and is movable along an axial direction of the first fastener; and after rotation of the position-limiting block, the position-limiting block at least partially protrudes from a bottom surface of the base;

wherein a spring is provided between the first fastener and the base for rotating the position-limiting block and/or restoring the protruding position-limiting block.

2. The leveling foot structure according to claim 1, wherein the bottom of a wall of the base connected with the position-limiting block is provided with a first installation hole at the end provided with the through-hole and by passing a second fastener through the first installation hole, the base is fixedly connected to a fixed body to be fixed to the household appliance, wherein being fixed the base.

3. The leveling foot structure according to claim 2, wherein an installation platform is provided at the bottom of the base, the installation platform is provided with a second installation hole and the base is connected to the household appliance by passing a third fastener through the second installation hole.

4. The leveling foot structure according to claim 2, wherein there are two first installation holes, located on two sides of the through-hole, respectively.

5. The leveling foot structure according to claim 4, wherein, the base is provided with a downwardly recessed groove in which the first installation hole is located.

6. The leveling foot structure according to claim 5, further comprising:

a foot cover plate which is fastened to the groove for opening and closing the groove.

7. The leveling foot structure according to claim 6, wherein the foot cover plate and the base are connected by a snap fit.

8. A household appliance, wherein the household appliance comprises:

a leveling foot structure, the leveling foot structure comprises:

a base, a through-hole being arranged at a side wall of the base;

a first fastener; and a position-limiting block, the position-limiting block being movably connected to the base by the first fastener and the first fastener partially passing through the through-hole to connect to the position-limiting block;

wherein the position-limiting block is rotatable around an axis of the first fastener and is movable along an axial direction of the first fastener; and after rotation of the position-limiting block, the position-limiting block at least partially protrudes from a bottom surface of the base;

wherein a spring is provided between the first fastener and the base for rotating the position-limiting block and/or restoring the protruding position-limiting block.

9. The household appliance according to claim 8, wherein, the household appliance is a cabinet refrigerator.

10. The household appliance according to claim 8, wherein the bottom of a wall of the base connected with the position-limiting block is provided with a first installation hole at the end provided with the through-hole and by passing a second fastener through the first installation hole, the base is fixedly connected to a fixed body to be fixed to the household appliance, wherein being fixed the base.

11. The household appliance according to claim 10, wherein an installation platform is provided at the bottom of the base, the installation platform is provided with a second installation hole and the base is connected to the household appliance by passing a third fastener through the second installation hole.

12. The household appliance according to claim 10, wherein there are two first installation holes, located on two sides of the through-hole, respectively.

13. The household appliance according to claim 12, wherein, the base is provided with a downwardly recessed groove in which the first installation hole is located.

14. The household appliance according to claim 13, further comprising:

a foot cover plate which is fastened to the groove for opening and closing the groove.

15. The household appliance according to claim 14, wherein the foot cover plate and the base are connected by a snap fit.

* * * * *